US011166574B2

(12) United States Patent
Miao et al.

(10) Patent No.: US 11,166,574 B2
(45) Date of Patent: Nov. 9, 2021

(54) AIRBAG AND A PILLOW WITH ADJUSTABLE HEIGHT USING SUCH AIRBAG

(71) Applicant: Paodong (Xiamen) Technology Co., Ltd., Xiamen (CN)

(72) Inventors: Jiangping Miao, Xiamen (CN); Xuan Zheng, Xiamen (CN); Jinghuang Kang, Xiamen (CN); Diwei Wu, Xiamen (CN); Yanjing Zhong, Xiamen (CN)

(73) Assignee: PAODONG (XIAMEN) TECHNOLOGY CO., LTD., Xiamen (CN)

( * ) Notice: Subject to any disclaimer, the term of this patent is extended or adjusted under 35 U.S.C. 154(b) by 117 days.

(21) Appl. No.: 16/656,692

(22) Filed: Oct. 18, 2019

(65) Prior Publication Data

US 2020/0245792 A1 Aug. 6, 2020

(30) Foreign Application Priority Data

Feb. 1, 2019 (CN) ..... 201920186650.8

(51) Int. Cl.
*A47G 9/10* (2006.01)

(52) U.S. Cl.
CPC ..... *A47G 9/1027* (2013.01)

(58) Field of Classification Search
CPC ..... A47G 9/1027; A47G 9/1081; A47G 9/10; A47C 27/088; A47C 27/18; A61G 13/1265
See application file for complete search history.

(56) References Cited

U.S. PATENT DOCUMENTS

2008/0104764 A1 5/2008 Chen
2015/0366368 A1* 12/2015 Cheng ..... A47C 7/021 5/644
2017/0071371 A1 3/2017 Zhang et al.

* cited by examiner

*Primary Examiner* — Fredrick C Conley
(74) *Attorney, Agent, or Firm* — Haynes and Boone, LLP

(57) ABSTRACT

The utility model provides an airbag for a pillow with adjustable height, wherein it is comprised: multiple airbag units arranged in stack, multiple supporting and connecting holes arranged in array in the opposite direction as the airbag units; two adjacent airbag units communicating through the said supporting and connecting holes; during the inflation or deflation process of the said airbag unit, the gas flows into or out of the airbag from the multiple supporting and connecting holes simultaneously, so that the inflation velocity of each part of the airbag unit is uniform, and the overall height of the airbag changes synchronously with the inflation or deflation. The utility model provides an airbag and a pillow for the height adjusting pillow, during the inflation or deflation process of the airbag unit, the overall height of the airbags changes synchronously with the inflation or deflation.

20 Claims, 4 Drawing Sheets

AIRBAG AND A PILLOW WITH ADJUSTABLE HEIGHT USING SUCH AIRBAG

PRIORITY

This application claims the benefit of Chinese patent application serial No. 201920186650.8, entitled "An Airbag and a Pillow with Adjustable Height using Such Airbag," filed Feb. 1, 2019, herein incorporated by reference in its entirety.

TECHNICAL FIELD

The present invention relates to the field of bedding, in particular to a pillow.

BACKGROUND

With the general acceleration of people's life rhythm, lack of sleep has become a common phenomenon among urban people today. Experts remind that lack of sleep is very harmful to health and should be addressed seriously. The harm of insufficient sleep is mainly reflected in: 1. Affect the creative thinking of the brain; 2. Affect the growth and development of teenagers; 3. Affect people's health, etc. This shows that a comfortable sleep is very important to the human body. In bed rest, the head needs to be supported by a pillow and tilted upward at a certain angle. Therefore, the suitability of pillows is particularly important. If the pillow is not suitable, it will cause cervical vertebra pain, insomnia and dreaminess, and fatigue the next day, which will affect the normal life the next day. However, it is extremely difficult to choose a suitable pillow because of each person's body curve, sleeping posture and other factors.

Since the suitable pillow heights are different when people lie on their sides or supine, there are some pillows on the market that can automatically adjust the height according to different sleeping postures. This type of pillow relies on the airbag inflation and deflation to change the height. However, since the airbag is in a shape of bulge-in-the-middle and compressive-around, the height of the entire pillow is not even, and thus the height of each part is not consistent, and there is a clear sensual difference when people lean against different positions of the pillow, rendering insufficient comfort.

SUMMARY

The main technical problem to be solved by the utility model is to provide an airbag and a pillow with adjustable height using such airbag, and the height of the airbag as a whole can be changed synchronously with inflation and deflation.

In order to solve the above technical problem, the utility model provides an airbag for the pillow with adjustable height, characterized in that: multiple airbag units arranged in stack, multiple supporting and connecting holes arranged in array in the opposite direction as the airbag units; two adjacent airbag units communicating through the said supporting and connecting holes.

During the inflation or deflation process of the said airbag unit, the gas flows into or out of the airbag from the multiple supporting and connecting holes simultaneously, so that the inflation velocity of each part of the airbag unit is uniform, and the overall height of the airbag changes synchronously with the inflation or deflation.

In a preferred embodiment, each airbag unit has a strip extending along a longitudinal direction of the airbag, the strip adheres the upper surface and the lower surface of the airbag unit together, making the airbag unit forming multiple interconnected child-airbags; the said child-airbags extend along the longitudinal direction, and both ends are in communication with the other child-airbags.

In a preferred embodiment: one of the described airbag units is provided with an air inlet.

In a preferred embodiment: the air inlet is set at a side of the airbag unit.

In a preferred embodiment: the lowermost airbag unit has a connecting belt for attaching the sponge on its lower surface, and the said connecting belt is along the longitudinal direction of the airbag, and its both ends are respectively press-fitted to the airbag unit.

The utility model also provides a pillow with adjustable height using such airbag as described above.

Being compared with the existing technology, the technical solution of the utility model has the following beneficial effects:

The utility model provides an airbag for the pillow with adjustable height, since what adopted is an airbag formed by combining airbag units arranged in a stack, the airbag units communicates with each other through an array of supporting and connecting holes, and when in inflation or deflation, the air flows in or out through the array of supporting and connecting holes, so that the various positions of the airbag unit can be inflated or deflated at the same time, thus the air in each part of the airbag unit is relatively uniform, then the height of each part of the airbag unit can be roughly consistent, and during inflation and deflation process, the inflation and deflating velocities of the various parts of the airbag unit can also be substantially the same, so that the height change rate of all parts of the airbag unit tend to be uniform during the inflation and deflation process.

Further, each airbag unit has a strip extending along the longitudinal direction of the airbag, the strip adheres the upper surface and the lower surface of the airbag unit together, so that the airbag forms multiple child-airbags that communicate with each other; Such, on one hand, is to reduce the area of the airbag unit that needs to be inflated, so that the inflation and deflation processes are faster, and on the other hand, the airbag unit is rendered highly uniform.

The lowermost airbag unit has a connecting belt for attaching the sponge on its lower surface, and the connecting belt will not wrinkle by the inflation and deflation of the airbag, so that the connected sponge can also be kept flat at all times.

DETAILED DESCRIPTION

The utility model is further described below with the drawings and specific embodiments.

Figure 1:
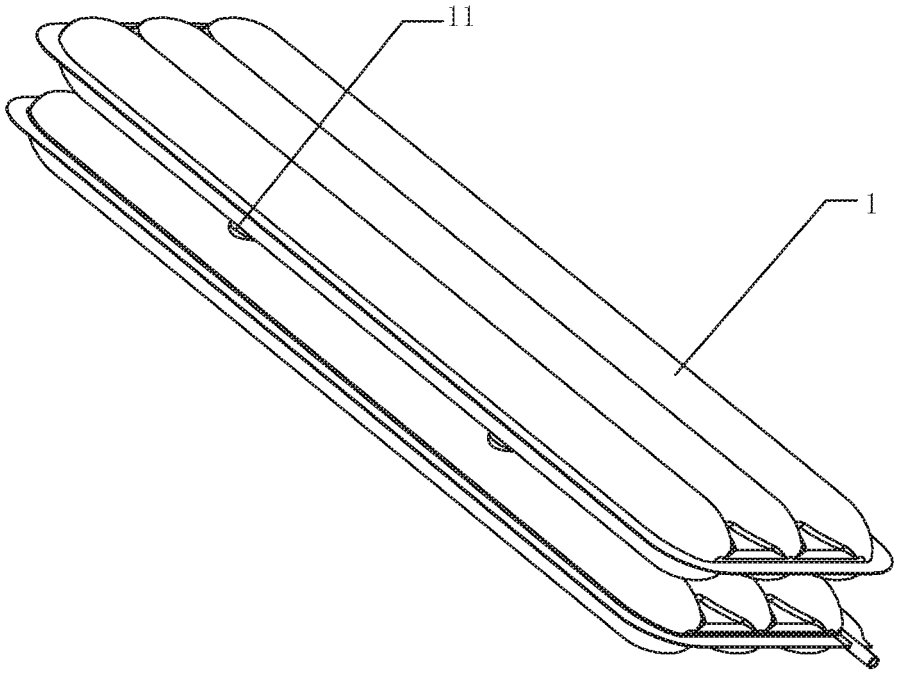
FIG. 1 is a perspective view of the airbag in the preferred embodiments of the utility model.
Figure 2:
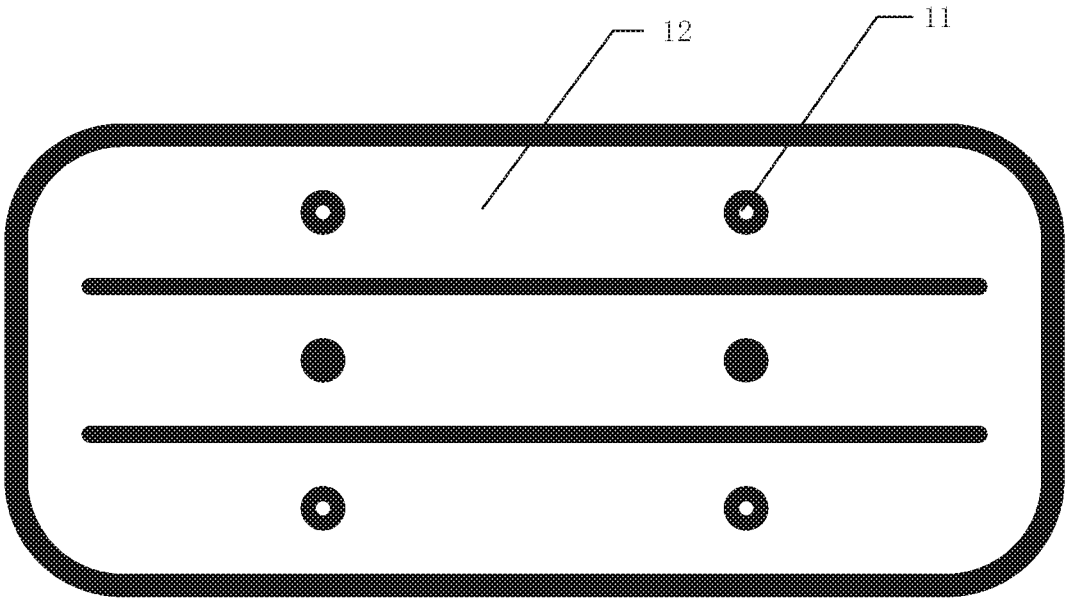
FIG. 2 is a plan view of the upper airbag unit in the preferred embodiments of the utility model.
Figure 3:
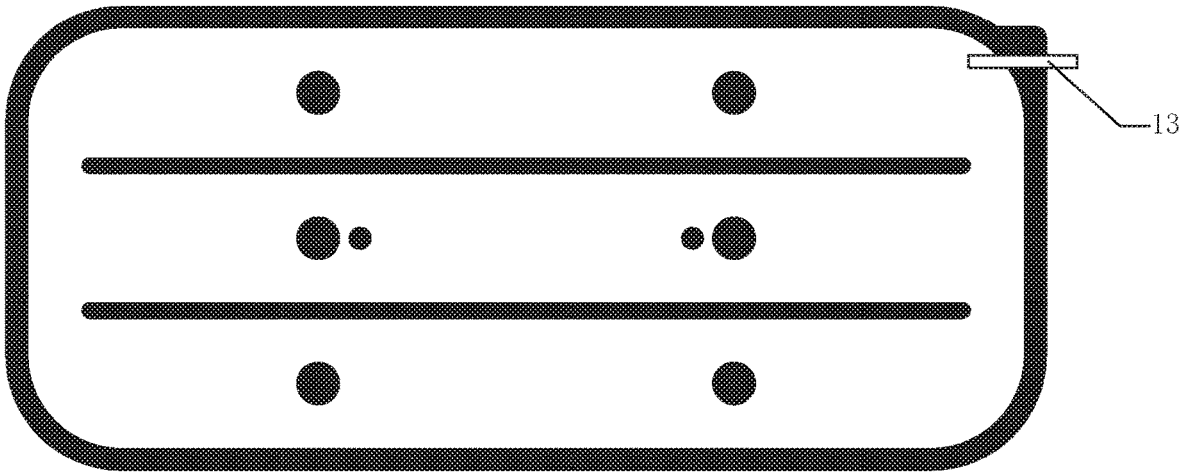
FIG. 3 is a plan view of the lower airbag unit in the preferred embodiments of the utility model.
Figure 4:
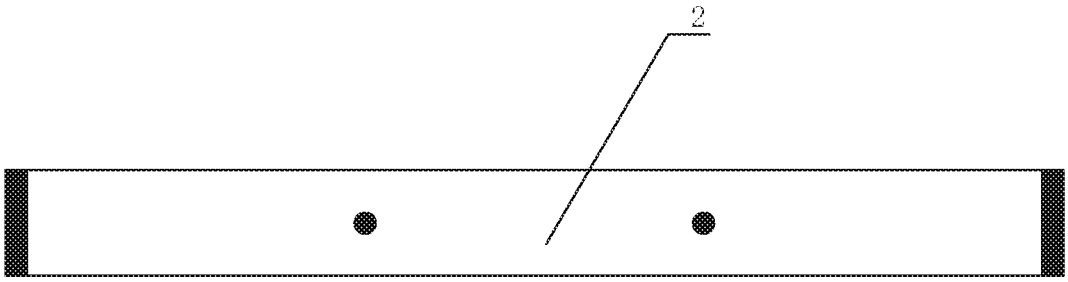
FIG. 4 is the schematic view of the connecting belt in the preferred embodiments of the utility model.

Refer to FIG. 1-FIG. 4, an airbag for the pillow with adjustable height, including: multiple airbag units (1)

arranged in stack, an array of supporting and connecting holes 11 are oppositely set on the side of the airbag units (1); two adjacent airbag units (1) are connected through the supporting and connecting hole 11.

During the inflation or deflation of the airbag unit 1, the gas simultaneously flows into or out of the airbag from the multiple supporting and connecting holes 11, that the inflation rates of the respective parts of the airbag unit 1 relatively uniform, and the overall airbag height can be changed synchronously with the inflation or deflation.

Due to the use of stacked airbag units (1) to form one airbag, airbag units (1) communicate with each other through the array of supporting and connecting holes 11, during the inflation or deflation process of the airbag unit 1, the gas flows into or out of the airbag unit 1 from the multiple supporting and connecting holes 11 simultaneously, so that the various positions of the airbag unit 1 can be inflated or deflated at the same time, thus the air in each part of the airbag unit 1 is relatively uniform, so that the height change rate of all parts of the airbag unit 1 tend to be uniform during the inflation and deflation process.

In this embodiment, each airbag unit 1 has a strip extending along the longitudinal direction of the airbag, and the strip adheres the upper surface and the lower surface of the airbag unit 1 together, so that the airbag unit 1 forms multiple child-airbags 12 that communicate with each other. The child-airbag 12 extends in the longitudinal direction and is in communication with the other child-airbags 12 at both ends. In the present invention, there are three child-airbags 12, and each child-airbag 12 is provided with two supporting and connecting holes 11 in the longitudinal direction, such that one airbag unit 1 has 2×3 supporting and connecting holes 11. Such structure, on one hand, to reduce the area of the airbag unit 1 that needs to be inflated, so that the inflation and deflation processes are faster, and on the other hand, the airbag unit 1 is rendered highly uniform.

Since all the airbag units (1) are in communication with each other, it only needs to be provided with only one air intake nozzles 13 in one of the airbag units (1) to inflate all airbag units (1).

The intake nozzle 13 is provided at the side of the airbag unit 1. According to the needs of the structural settings, the air intake nozzle 13 can also be set at any other location, which is a simple changeable matter of this embodiment.

The lowermost airbag unit 1 has a connecting belt 2 for adhering the sponge on its lower surface, and the said connecting belt 2 is along the longitudinal direction of the airbag, and its both ends are respectively press-fitted to the airbag unit 1. The connecting belt 2 will not wrinkle by the inflation and deflation of the airbag, so that the connected sponge can also be kept flat at all times. Thus, the adhesion between the belt 2 and the sponge is relatively stable and does not come loose.

Through testing, in this design, an airbag with a flattened area of 50×23 cm can be adjusted to a height of 7.5 cm in about 1 minute and 10 seconds using a given air pump. Using the same air pump, a single-layer airbag takes at least 8 minutes to reach the same height. Therefore, this design greatly reduced the waiting time and power consumption.

The utility model also provides a pillow with adjustable height using such airbag as described above.

The above is only some preferred embodiments of the utility model, but the scope of the utility model is not limited thereto, the disclosed variations or technical scopes of this utility model can be easily conceived by the technical personnel in this field. Alternative plans are intended to be included within the scope of this utility model. Therefore, the protection scope of this utility model should be determined by the scope of the Claims.

What is claimed is:

1. A pillow with adjustable height, comprising:

a bottom airbag unit;

a top airbag unit stacked above the bottom airbag unit, the top and bottom airbags having two opposing surfaces directly interfacing each other; and an array of supporting and connecting holes through the two opposing surfaces of the bottom and top airbag units, the bottom and top airbag units communicating through the array of supporting and connecting holes, wherein the array of supporting and connecting holes is configured to inflate or deflate the bottom and top airbag units simultaneously and achieve a substantially uniform height changing rate across the bottom and top airbag units, and wherein each of the bottom and top airbag units includes at least one strip dividing the respective airbag unit into multiple child-airbags.

2. The pillow of claim 1, further comprising:

an air inlet in direct communication with one of the bottom and top airbag units.

3. The pillow of claim 2, wherein the air inlet is in direct communication with the bottom airbag unit.

4. The pillow of claim 3, wherein the air inlet is located at a side of the bottom airbag unit.

5. The pillow of claim 1, wherein each of the bottom and top airbag units extends lengthwise in a first direction and the at least one strip of the respective airbag unit extends lengthwise along the first direction.

6. The pillow of claim 1, wherein the multiple child-airbags communicate with each other at both ends of the respective airbag unit.

7. The pillow of claim 1, wherein in a top view the array of supporting and connecting holes is arranged in multiple rows, and wherein each of the multiple child-airbags is in direct communication with a row of the array of supporting and connecting holes.

8. The pillow of claim 1, wherein each of the bottom and top airbag units includes two strips and three child-airbags, and the array of supporting and connecting holes is a 2×3 array.

9. The pillow of claim 1, wherein the array of supporting and connecting holes includes adjacent supporting and connecting holes that are spaced further away along a longitudinal direction of the bottom and top airbag units than along a second direction perpendicular to the longitudinal direction.

10. The pillow of claim 1, further comprising:

a connecting belt adjacent to the bottom airbag unit, wherein the connecting belt is operable to adhere a sponge.

11. The pillow of claim 1, wherein in a top view the plurality of supporting and connecting holes are arranged in an array of N columns and M rows, each of N and M being an integer larger than one.

12. The pillow of claim 1, wherein the bottom airbag unit includes at least one strip adhering upper and lower surfaces of the bottom airbag.

13. The pillow of claim 12, wherein in a top view the plurality of supporting and connecting holes are divided by the at least one strip into multiple rows distributed on both sides of the at least one strip.

14. A pillow with adjustable height, comprising:

an inflatable airbag, wherein the inflatable airbag includes a plurality of airbag units stacked on each other, wherein each of the plurality of airbag units includes at least one strip adhering middle portions of upper and lower surfaces of the respective airbag unit;

a plurality of supporting and connecting holes interposed between adjacent airbag units, wherein the plurality of supporting and connecting holes is operable to inflate or deflate the plurality of airbag units simultaneously;

an air inlet in direct communication with one of the plurality of airbag units;

a connecting belt adhered to a bottommost airbag unit; and a sponge adhered to the connecting belt.

15. The pillow of claim 14, wherein each of the plurality of airbag units include multiple child-airbags extending in a longitudinal direction of the inflatable airbag and communicating with each other at both ends of the respective airbag unit.

16. The pillow of claim 15, wherein the air inlet is in direct communication with one of the multiple child-airbags located at a bottom and an edge of the inflatable airbag.

17. The pillow of claim 14, wherein in a top view the plurality of supporting and connecting holes are arranged in an N×M array, each of N and M being an integer larger than one.

18. An airbag for a pillow with adjustable height, comprising:

first and second airbag units arranged in a stack, each of the first and second airbag units including at least one strip dividing interior space of the respective airbag unit into multiple sub-space; and multiple supporting and connecting holes arranged in an array that is interposed between the first and second airbag units, wherein the multiple supporting and connecting holes are configured to inflate and deflate each airbag unit simultaneously, such that an overall height of the airbag in various positions of the airbag changes uniformly.

19. The airbag of claim 18, wherein the at least one strip extends along a longitudinal direction of the airbag, the at least one strip adhering upper and lower surfaces of the respective airbag unit, thereby equally dividing the respective airbag unit into the multiple sub-space.

20. The pillow of claim 18, wherein the interior space of the respective airbag unit is equally divided by the at least one strip into the multiple sub-space.

* * * * *